US005707096A

United States Patent [19]

Gregory

[11] Patent Number: 5,707,096

[45] Date of Patent: Jan. 13, 1998

[54] BOTTLE CARRIER

[76] Inventor: Jerry E. Gregory, 700 N. Decatur St., Watkins Glen, N.Y. 14891

[21] Appl. No.: 478,516

[22] Filed: Jun. 7, 1995

[51] Int. Cl.[6] ..... B65D 71/00

[52] U.S. Cl. ..... 294/87.2; 294/163

[58] Field of Search ..... 294/87.2, 87.22, 294/87.24, 87.26, 87.28, 159, 162, 163, 165; 206/145, 147, 158, 162, 167–169, 199, 201, 427

[56] References Cited

U.S. PATENT DOCUMENTS

| | | | |
|---|---|---|---|
| 2,348,187 | 5/1944 | Beskin | 294/87.28 |
| 2,407,529 | 9/1946 | Bertram | 294/87.26 |
| 2,415,598 | 2/1947 | Mattson | 294/87.28 |
| 2,454,178 | 11/1948 | Howell | 294/87.26 |
| 2,512,060 | 6/1950 | Harris | 294/87.28 |
| 2,518,823 | 8/1950 | Schneider | 294/87.28 |
| 2,996,329 | 8/1961 | Glazer | 294/87.2 |
| 3,144,269 | 8/1964 | Orr | 294/87.28 |

FOREIGN PATENT DOCUMENTS

| | | | |
|---|---|---|---|
| 2401077 | 7/1975 | Germany | 294/87.26 |

*Primary Examiner*—Johnny D. Cherry

[57] ABSTRACT

The present invention is directed to an apparatus that carries bottles by their necks. The apparatus of the present invention comprises a rigid structure having at least two keyhole openings formed in the structure for receiving the head and annular neck ring of a bottle therethrough. The keyholes are positioned such that when the bottles are pushed into the narrower slot of the opening that the main body of the bottles remain in contact, thereby preventing the bottles from slipping out of the device during use. A handle is attached to the top of the rigid structure for hand carrying the device. The device can further incorporate an additional locking mechanism to block off the wider portion of the keyhole opening to prevent the bottles from becoming disengaged.

1 Claim, 3 Drawing Sheets

BOTTLE CARRIER

BACKGROUND

The invention relates to bottle carriers. More particularly, this invention relates to soda bottle carriers which are adapted to carry a number of soda bottles by their necks.

Many carbonated beverages such as soda and flavored seltzers are sold in plastic bottles of the two-liter size. Generally, these bottles are the same size and shape. They have a large main body portion which terminates in a narrow neck. The neck is characterized by a threaded portion onto which the cap fits. There is also an annular neck ring positioned at the bottom of the threaded portion.

When a person goes to the supermarket or the convenience store to pick up a few bottles of soda for a party or to take to the beach or to a picnic, there is often a problem of how to carry the bottles from the store to the car and from the car to their place of ultimate use. Carrying the bottles by hand is inefficient and cumbersome. Generally, only two bottles can be held at once, one in each hand. Attempting to carry more than two bottles requires either multiple trips or risking dropping them.

Packaging the bottles in the typical brown paper bags offered by shops is impractical. The bags are not sturdy enough to sufficiently accommodate the size and weight of more than two two-liter bottles. Also paper bags are bulky and hard to carry, particularly when there is more than one bag to carry at a time.

Packaging the bottles in the plastic handle bags also offered by shops presents similar problems. The plastic bags only have the capacity to effectively hold two two-liter bottles. When a person attempts to carry more than two bottles, the handles tend to stretch and then break. Additionally, the weight of soda bottles requires the use of two plastic bags, one placed inside the other. The use of two plastic bags produces excess waste. Also, the narrow rounded bottoms of the bottles often causes them to fall over when the bag is placed on a flat surface. Furthermore, the use of both plastic and paper bags poses other environmental concerns, such as: 1) creating more trash; 2) expending natural resources in the creation and disposal of the bags.

Therefore, there is a need for an efficient cost effective method for carrying multiple soda bottles. Furthermore, there is a need for a reusable carrying device which can accommodate and balance the weight of two or more bottles which have an annular neck ring.

SUMMARY

The present invention is directed to an apparatus that satisfies this need. The apparatus of the present invention comprises a rigid planar structure having at least two juxtaposed keyhole openings formed in the structure for receiving the head and neck of a bottle therein. The keyholes are positioned such that when the bottles are pushed into the narrower slot of the opening that the main body of the bottles remain in contact, thereby preventing the bottles from slipping out of the device during use. A handle is attached to the top of the rigid structure for hand carrying the device. The device can further incorporate an additional locking mechanism to block off the wider portion of the keyhole opening to prevent the bottles from becoming disengaged.

Therefore, it is an object of this invention to provide a bottle carrier which is reusable and easy to use.

It is a further object of this invention to provide a bottle carrier which can accommodate two or more bottles.

It is another object of this invention to provide a bottle carrier which has keyhole openings for receiving the bottle therethrough and then locking the bottle into position within the carrier.

It is still another object of this invention to provide a bottle carrier which is made from a rigid light weight material.

It is still yet another object of this invention to provide a bottle carrier wherein the positioning of the keyhole openings and the force of gravity itself prevent the bottles from becoming disengaged during use.

It is still a further object of this invention to provide a bottle carrier wherein the keyhole opening has a wider receiving end and a narrower holding end with an underside chamfer for accommodating the annular neck ring of a bottle, while at the same time keeping the upper body curvature of the bottle in contact with the rigid structure of the carrier.

It is still yet a further object of this invention to provide a bottle carrier with an additional locking mechanism which blocks off the wider receiving end of the keyhole openings.

BRIEF DESCRIPTION OF THE DRAWINGS

These and other features, aspects and advantages of the present invention will become better understood with reference to the following description, appended claims and accompanying drawings where:

DETAILED DESCRIPTION OF THE DRAWINGS

Figure 4:
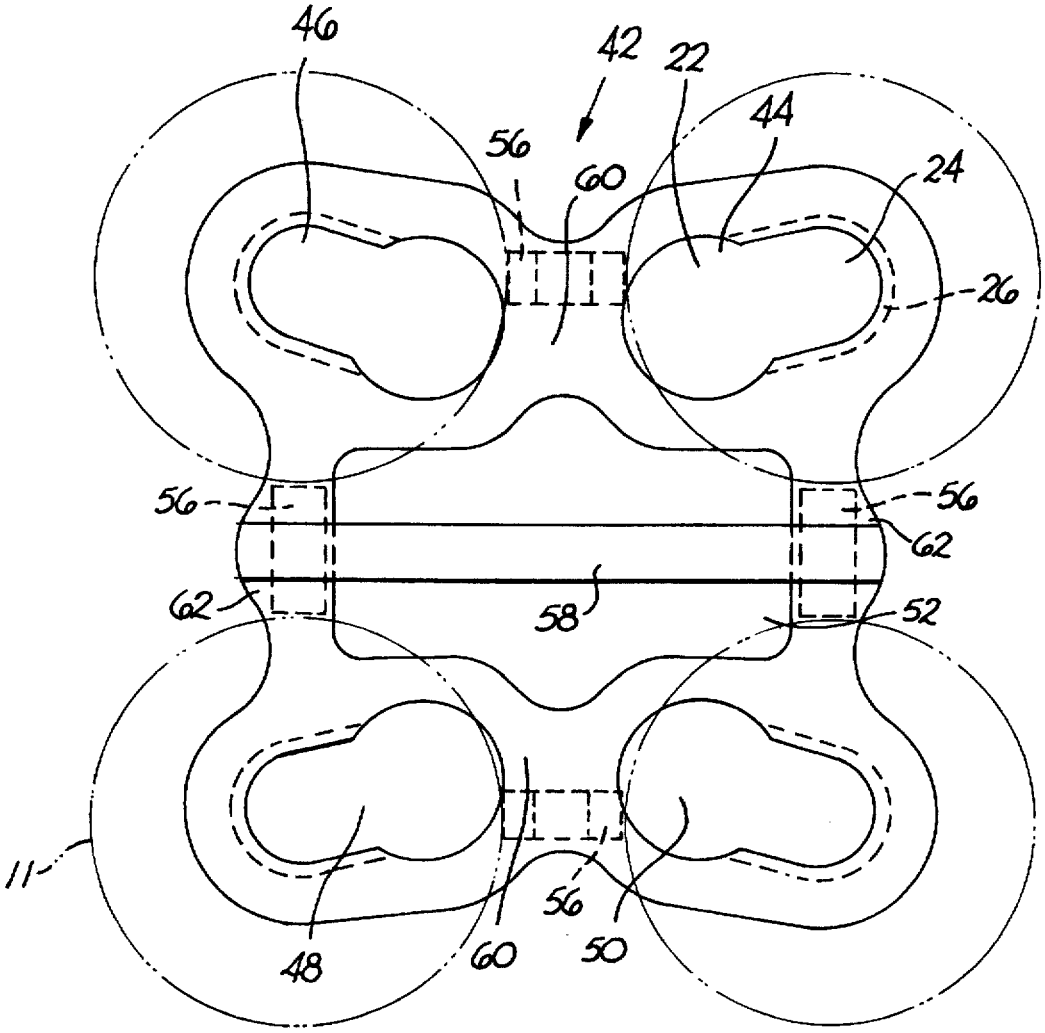
FIG. 4 is a top perspective view of a second embodiment of the invention.
Figure 6:
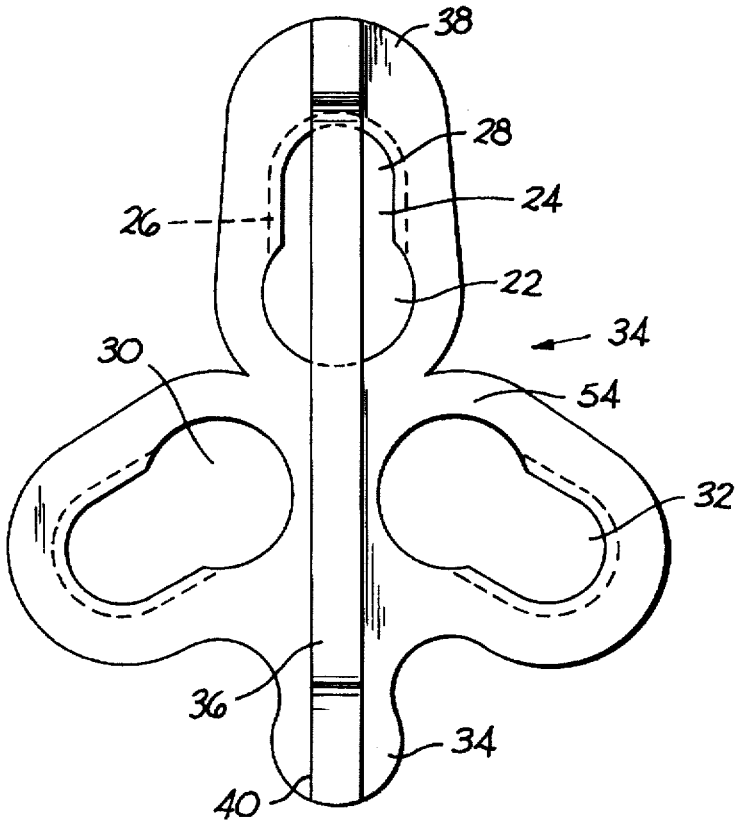
FIG. 6 is a top perspective view of a third embodiment of the invention.

The invention is a bottle carrier designed to carry two, three, or four bottles such as two-liter soda bottles 11 or any other bottle which has an annular neck ring 66. There are disclosed here three different embodiments of the invention which incorporate the same basic structure, as shown in FIGS. 1, 4 and 6.

Figure 1:
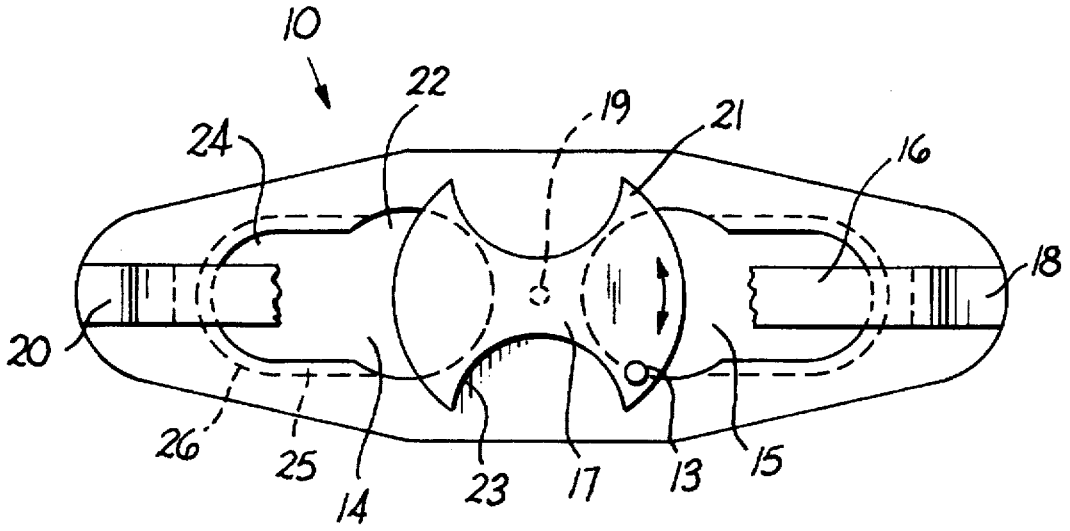
FIG. 1 is a top perspective view of one embodiment of the invention.
Figure 2:
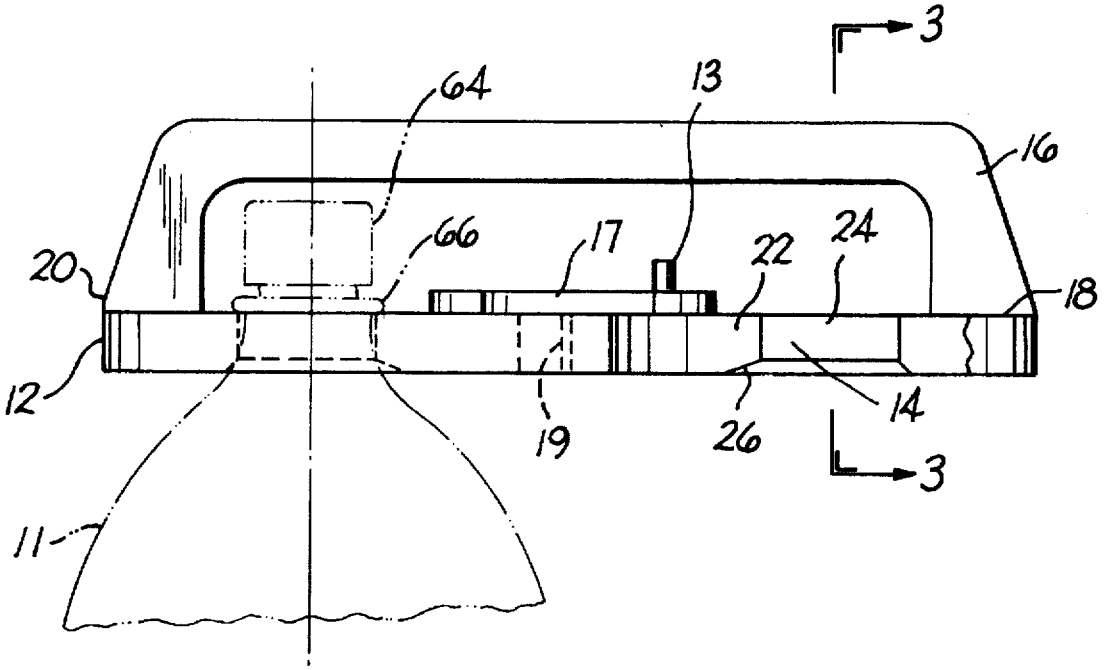
FIG. 2 is a side perspective view of the device of FIG. 1 shown partially in cross section.
Figure 3:
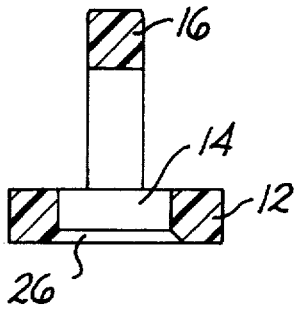
FIG. 3 is a cross sectional view of the device of FIG. 2 along the line 3—3 of FIG. 2.

Referring now to FIGS. 1, 2 and 3, a first embodiment of the invention is shown. The bottle carrier 10 consists of a rigid piece of material such as plastic, metal or wood. The preferred material is injection-molded recyclable plastic. The device 10 has a main body portion 12 which is relatively oblong shaped and formed from a single piece of material. Dual keyhole openings 14 and 15 are formed in the main body portion 12. The keyhole openings have both a receiving end 22 and a holding end 24. The receiving end receives the head 64 and annular neck ring 66 of a bottle 11 through it. The bottle 11 then slides back out of the receiving end 22 and into the holding end 24 such that the annular neck ring 66 of a bottle rests against the top edges 25 of the holding end 24 of the keyhole opening 14. A chamfer 26 is formed along the inside edge of the holding end 24 angled upwardly from the bottom edge to accommodate the curve of the bottle 11. FIGS. 2 and 3 show the angle of the chamfer 26.

The two keyhole openings 14 and 15 in this embodiment are positioned opposite each other to effectively use the available space and gravitational forces to maintain the position of the bottles 11 within the holder 10. The device is symmetrical about its vertical and horizontal center lines.

A handle 16 is fitted to the top of each end 18 and 20 of the main body portion 12. The handle 16 extends the length of the main body portion 12 of the device 10 and is high enough to accommodate both the top of the bottle and the hand of the user.

FIGS. 1 and 2 show the device incorporating the locking disc 17. The locking disc 17 is attached to the top center of the main body portion 12 by a single pin 19. The locking disc 17 rotates about the pin 19. A small peg handle 13 is positioned on one corner of the locking disc 17 to aid in rotation of the disc 17. The locking disc 17 is in the shape of a circle having two convex portions 21 and two concave portions 23. The concave portions 23 match the shape and size of the receiving end 22 of the keyhole opening 14.

The locking disc 17 is in the unlocked position when the concave portions 23 of the locking disc 17 are aligned with the receiving end 22 of the keyhole opening 14. To block off the receiving end 22, the locking disc 17 is rotated such that the convex portions 21 extend into the receiving end 22 of the keyhole opening 14.

Referring now to FIG. 6, a second embodiment 34 of the device is shown which has three keyhole openings 28, 30 and 32 for holding bottles formed in the main body portion 54 of the device. In this embodiment, the main body portion 54 is approximately triangularly shaped. The three keyhole openings 28, 30 and 32 form the three points of the triangle. These three keyhole openings are positioned such their centers are approximately 120° apart. Again, this embodiment of the device is symmetrical about its vertical centerline.

Each of the keyhole openings 28, 30 and 32 is constructed the same as the keyhole openings 14 and 15 in the first embodiment 10. There is a receiving end 22 and a holding end 24. A chamfer 26 extends along the inside edge of the holding end 24 at a downward angle.

There is a handle attachment wing 34 positioned opposite keyhole opening 28. The handle 36 is attached to the outside edge 38 of keyhole opening 28 and the outside edge 40 of handle attachment wing 34. This placement of the handle is important for balance of the device when the bottles are in position.

Figure 5:
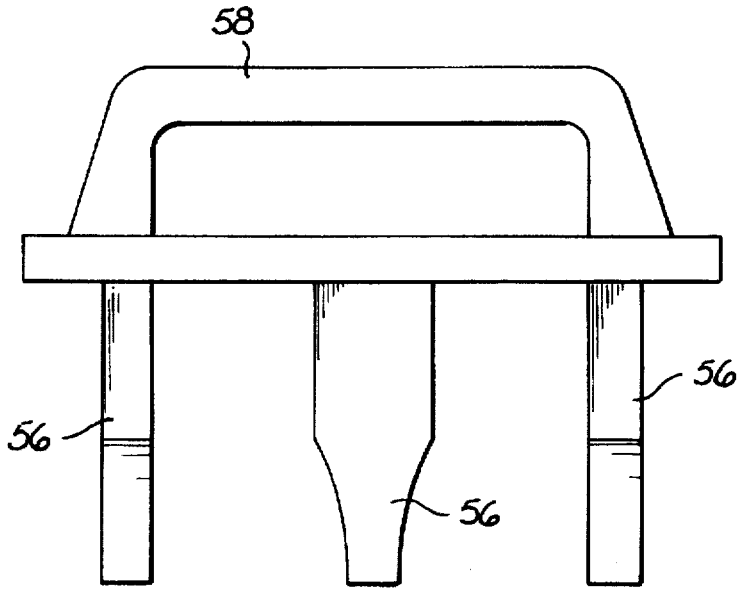
FIG. 5 is a side perspective view of the device of FIG. 4.

A third embodiment of the device 42 is shown in FIGS. 4 and 5. This bottle carrier 42 is equipped with four keyhole openings 44, 46, 48 and 50 for holding bottles. Here the device 42 is constructed such that the four keyhole openings 44, 46, 48 and 50 are positioned along the outer periphery of the device thereby forming a square. The center 52 of the device is characterized by a rectangular opening with concavities positioned at the joining points 60 of the keyhole openings. The keyhole openings are formed the same as the keyhole openings of the other two embodiments. There is a receiving end 22 and a holding end 24 which has a chamfer 26 lining its inside edge formed at an upward angle from the bottom edge of the opening. This embodiment is also symmetrical about its horizontal and vertical centerlines.

Additionally, there are four bottle spacers 56 which extend downwardly from the bottom of the main body portion of the device. These bottle spacers 56 are attached to the bottom of the main body portion 42 at both the joining points 60 of the keyhole openings and the bridge portions 62. The handle 58 is attached at either end of the rectangular center 52 to the bridge portions 62.

To use the device, the user first tilts the bottom of the bottle 11 away from the receiving end 22 of the keyhole opening 14. The user then pushes the head of the bottle 64 through the receiving end 22 of the keyhole opening 14 so that the annular neck ring 66 is above the top of the main body portion 12. The user then slides the bottle 11 back so that annular neck ring 66 rests on the top surface of the holding end 24 of the keyhole opening 14, and the curved upper body portion of the bottle rests against the spacer 56 on two of its sides. The bottle 11 is then in the carrying position, as shown in FIG. 2.

To remove a bottle from the carrier 10, the foregoing procedure is reversed. The bottle 11 slides forward into the receiving end 22 of the opening 14. The bottom of the bottle is tilted away from the receiving end 22 and pulled out.

It should be clear that the present invention is not limited to the foregoing descriptions and drawings, which merely illustrate the preferred embodiment thereof. Slight departures may be made from the description without departing from the intended scope of the claims.

What is claimed is:

1. A bottle carrier, comprising:

a single, substantially elongated oval rigid member having at least two openings therein, each opening having a wide end for receiving the head and annular neck ring of a bottle therethrough and a narrow end having a top portion and a bottom portion for locking said bottle into position, said openings being positioned opposite each other lengthwise on said single substantially oval rigid member such that said wide ends are located near the center of said single rigid member, and said narrow ends are located near the outward apexes of said single rigid member;

a chamfer lining said bottom portion of said narrow end of said openings, said top portion of said narrow end having parallel sides;

a handle being equal in length to said single rigid member and integrally attached to the outward apexes of said single substantially elongated oval rigid member; and a rotating locking mechanism attached to said single substantially elongated oval rigid member, said mechanism being formed of a circular disk with at least two substantially semicircle portions cut therein, said semicircle portions matching the shape, size, and number of said wide end of said openings whereby multiple bottles may be engaged or removed simultaneously.

* * * * *